US007979953B2

(12) United States Patent
Yoo

(10) Patent No.: US 7,979,953 B2
(45) Date of Patent: Jul. 19, 2011

(54) VACUUM CLEANER

(75) Inventor: Dong-hun Yoo, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 360 days.

(21) Appl. No.: 12/217,842

(22) Filed: Jul. 9, 2008

(65) Prior Publication Data

US 2009/0178229 A1 Jul. 16, 2009

Related U.S. Application Data

(60) Provisional application No. 61/011,341, filed on Jan. 16, 2008.

(30) Foreign Application Priority Data

Mar. 10, 2008 (KR) ..... 10-2008-0022037

(51) Int. Cl.
*A47L 9/32* (2006.01)

(52) U.S. Cl. ..... 15/323; 15/331; 15/334; 15/335

(58) Field of Classification Search ..... 15/323, 15/331, 334, 335, 336; *A47L 9/32*
See application file for complete search history.

(56) References Cited

U.S. PATENT DOCUMENTS

| | | | | |
|---|---|---|---|---|
| 5,125,127 | A | 6/1992 | Bach et al. | 15/323 |
| 5,309,600 | A | 5/1994 | Weaver et al. | 15/328 |
| 5,524,321 | A | 6/1996 | Weaver et al. | 15/329 |
| 6,058,559 | A | 5/2000 | Yoshimi et al. | |

FOREIGN PATENT DOCUMENTS

| | | |
|---|---|---|
| KR | 1020050061732 | 6/2005 |
| KR | 1020070021472 | 2/2007 |
| WO | WO2007/135395 | 11/2007 |

OTHER PUBLICATIONS

Combined Search and Examination Report dated Dec. 22, 2008 corresponding to United Kingdom Patent Application No. 0815425.4.

*Primary Examiner* — David A Redding
(74) *Attorney, Agent, or Firm* — Ohlandt, Greeley, Ruggiero & Perle, LLP

(57) ABSTRACT

A vacuum cleaner that is convertible between an upright mode and a canister mode by use of a hose is provided. The vacuum cleaner includes a hose clamping unit capable of protruding outside the cleaner body or retreating back to the cleaner body according to a mode change of the vacuum cleaner.

18 Claims, 6 Drawing Sheets

VACUUM CLEANER

CROSS-REFERENCE TO RELATED APPLICATIONS

This application claims the benefit under 35 U.S.C. §119 of U.S. Provisional Application No. 61/011,341, filed on Jan. 16, 2008, in the United States Patent and Trademark Office, and Korean Patent Application No. 10-2008-0022037, filed on Mar. 10, 2008, in the Korean Intellectual Property Office, the entire contents of both of which are hereby incorporated by reference.

BACKGROUND OF THE INVENTION

1. Field of the Invention

The present disclosure relates to a vacuum cleaner, and more particularly, to a vacuum cleaner convertible between an upright mode and a canister mode.

2. Description of the Related Art

Various types of vacuum cleaners are available for cleaning different types of objects. An upright type cleaner consists of a suction port body connected directly to a cleaner body and is particularly effective for cleaning a carpeted floor. A canister type cleaner consists of a suction port body connected to a cleaner body indirectly, that is, via a hose and an extension pipe. The canister type cleaner is easier to operate and is thus used especially for the narrow places such as flights of the stairs, wooden floor, or any place that does not give easy access to the cleaner.

U.S. Pat. No. 5,309,600, entitled 'Vacuum cleaner with a detachable vacuum module', and U.S. Pat. No. 5,524,321, entitled 'Vacuum cleaner with a detachable vacuum module', disclose an example of an upright type vacuum cleaner having a lift-off structure, in which the main cleaner body is detachable from a suction port body, to provide the functions of both canister and upright type vacuum cleaners.

SUMMARY OF THE INVENTION

An aspect of the present disclosure is to address at least the above problems and/or disadvantages and to provide at least the advantages described below. Accordingly, an aspect of the present disclosure is to provide a vacuum cleaner capable of operating in both upright and canister modes, wherein a part of a hose clamping unit protrudes out of the cleaner body in the upright mode, and the hose clamping unit retreats into the cleaner body in the canister mode.

In accordance with an aspect of the present disclosure, a vacuum cleaner is convertible between an upright mode and a canister mode, as a cleaner body, to which an extension pipe is connected via a hose, is separated from or connected to a suction port body. The vacuum cleaner includes a hose clamping unit capable of protruding outside the cleaner body or retreating back to the cleaner body according to a mode change of the vacuum cleaner.

A portion of the hose clamping unit to fix the hose protrudes outside the cleaner body, when the extension pipe is connected to the cleaner body.

A portion of the hose clamping unit to fix the hose protrudes outside the cleaner body, when the cleaner body is connected to the suction port body.

The protruding portion of the hose clamping unit is in horizontal or vertical direction with respect to the cleaner body.

The hose clamping unit is elastically formed on the cleaner body.

The hose clamping unit includes at least one clamp in which a first side is hinged and a second side includes a fixing portion to fix the hose, and an elastic member disposed around a hinged portion of the clamp.

The elastic member is a coil spring to connect the clamp to a portion of the cleaner body.

The elastic member includes torsion springs disposed around hinged portions of the clamp.

The hose clamping unit includes a first clamp and a second clamp provided in a symmetric arrangement in which sides adjacent to each other are hinged to the cleaner body, and sides apart from each other include fixing portions to fix the hose, and an elastic member to elastically support the first and second clamps with respect to the cleaner body.

The elastic member is a coil spring to connect the sides of the first and second clamps that faces each other.

The elastic member includes a first torsion springs and a second torsion spring formed on hinged portions of the first and second clamps.

The fixing portion is provided in a circular arrangement to wrap the hose.

BRIEF DESCRIPTION OF THE DRAWING FIGURES

The above and other objects, features, and advantages of certain exemplary embodiments of the present disclosure will be more apparent from the following description taken in conjunction with the accompanying drawings, in which.

DETAILED DESCRIPTION OF THE EXEMPLARY EMBODIMENTS

Figure 1:
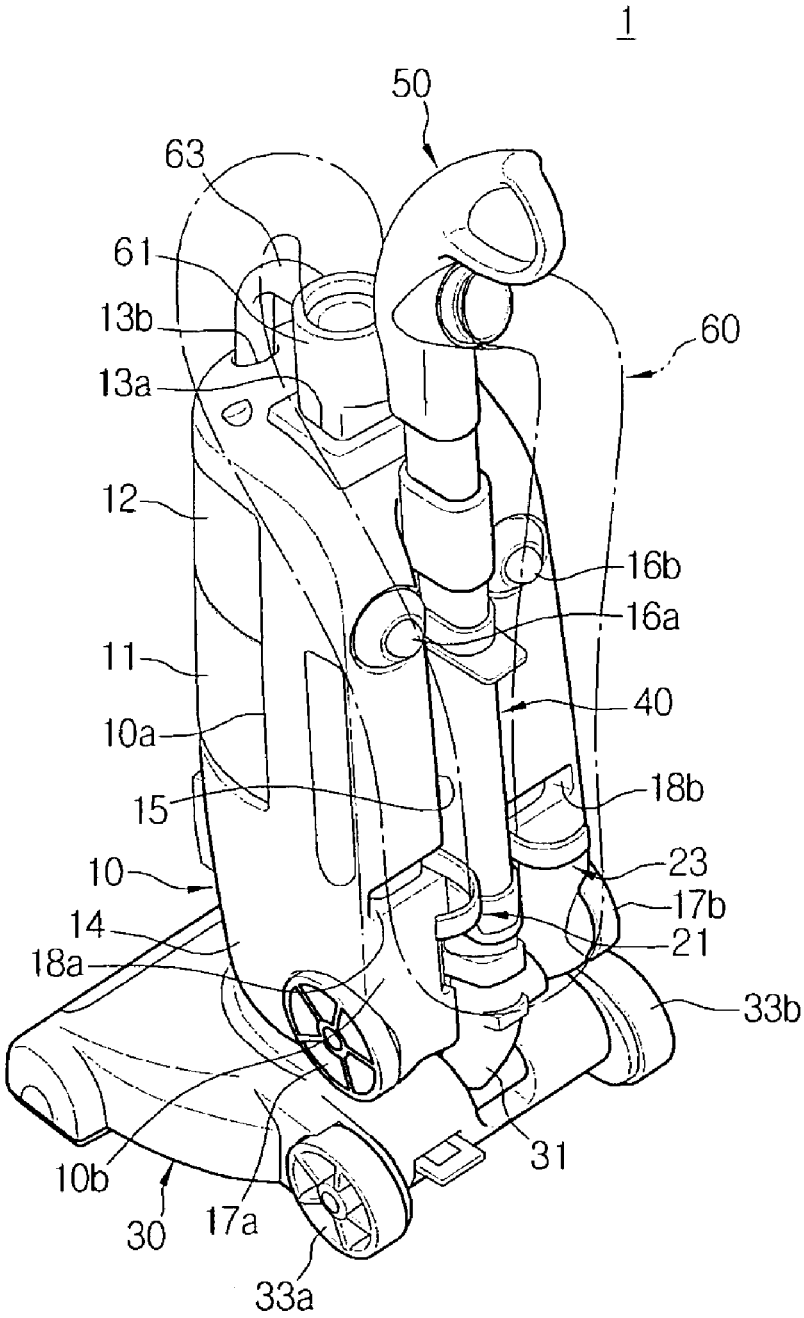
FIG. 1 is a perspective view of a vacuum cleaner in an upright mode according to a first exemplary embodiment of the present disclosure.

Hereinafter, the first exemplary embodiments of the present disclosure will be described in detail with reference to FIGS. 1 to 6.

A vacuum cleaner 1 according to the first exemplary embodiment of the present disclosure includes a cleaner body 10, a hose clamping unit 20, a suction port body 30, an extension pipe 40, an operating handle 50, and a hose 60.

Figure 2:
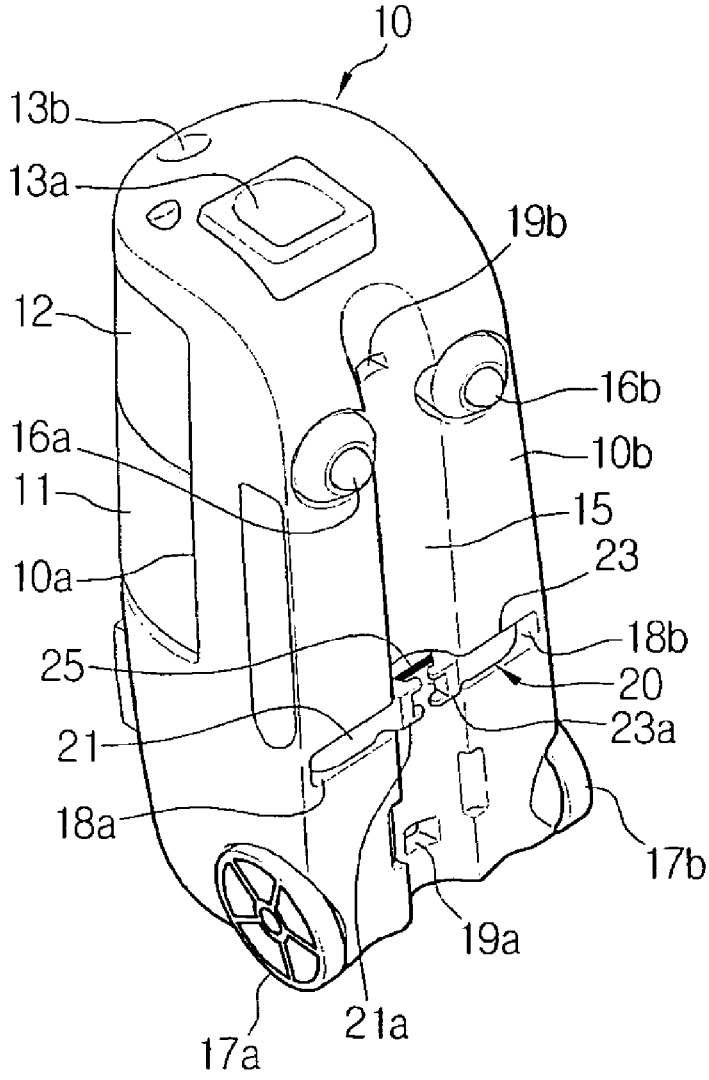
FIG. 2 is a perspective view illustrating a cleaner body of the vacuum cleaner according to the first exemplary embodiment of the present disclosure.

Referring to FIGS. 1 and 2, the cleaner body 10 includes a receiving portion 10*a* formed on a front to which a dust receptacle 11 is removably mounted, and a cyclone portion 12 formed above the receiving portion 10*a* to separate dust particles from the air by using centrifugal force. The cleaner body 10 also includes a connector receiving hole 13*a* formed on an upper portion to receive a hose connector 61, a handle receiving hole 13*b* to fixedly receiving a leading end of the operating handle 63, and a suction motor (not illustrated) disposed within a lower portion 14.

The cleaner body 10 also includes a longitudinal hole 15 formed along a rear surface 10*b* to face the extension pipe 40, to receive the extension pipe 40. The longitudinal hole 15 includes a first fixing hole 19*a* and a second fixing hole 19*b* formed on an upper inner portion and a lower inner portion.

Figure 3:
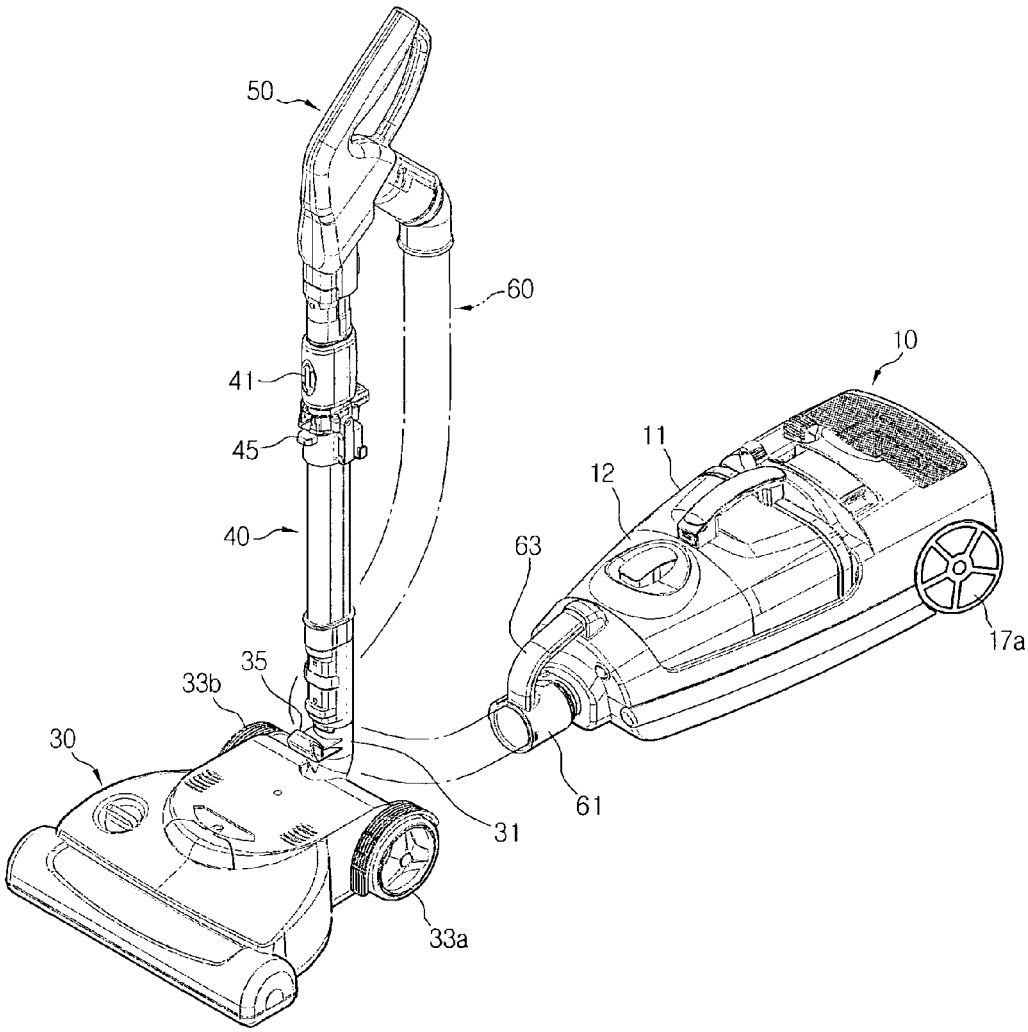
FIG. 3 is a perspective view illustrating the vacuum cleaner in a canister mode according to the first exemplary embodiment of the present disclosure.

Referring to FIG. 3, the cleaner body 10 is arranged so that the rear side of the cleaner body 10 faces the floor in the canister mode. In order for the cleaner body 10 to move smoothly along the floor, there are a pair of symmetric front wheels 16*a* and 16*b* formed on both sides of the longitudinal hole 15 on the upper portion of the rear side 10*b*, and a pair of symmetric rear wheels 17*a* and 17*b* formed on both sides of the longitudinal hole 15 on the lower side of the cleaner body 10. The symmetric front wheels 16*a* and 16*b* may be arranged close to the center of the cleaner body 10 to enable the cleaner body 10 to shift moving direction efficiently.

Figure 4:
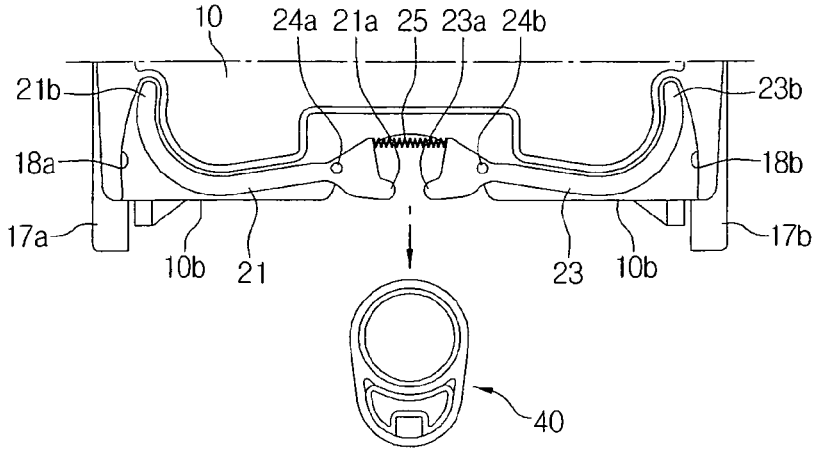
FIG. 4 illustrates a hose clamping device of the vacuum cleaner according to the first exemplary embodiment of the present disclosure in the canister mode.
Figure 5A:
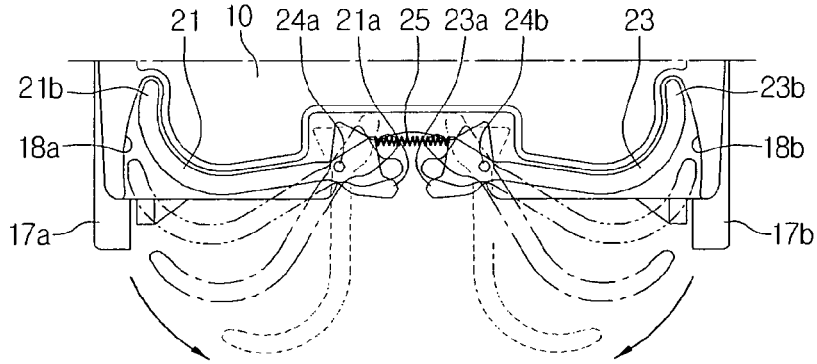
FIGS. 5A and 5B illustrates the hose clamping device of the vacuum cleaner according to the first exemplary embodiment of the present disclosure during movement between the canister and upright modes.
Figure 5B:
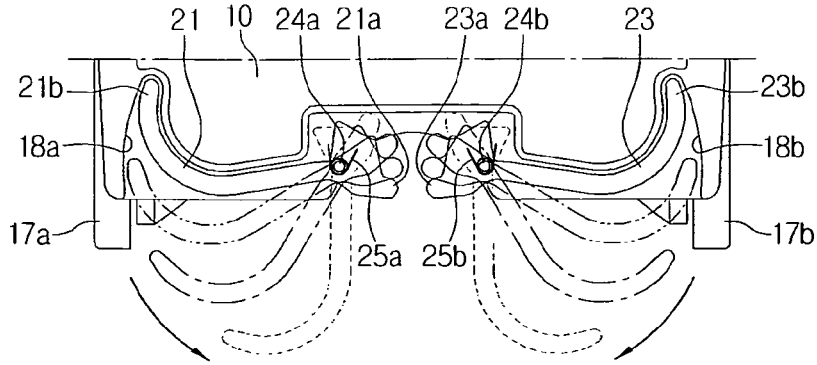

Referring to FIG. 4, the hose clamping unit 20 includes first and second clamps 21 and 23, and an elastic member 25. The first and second clamps 21 and 23 are disposed in first and second insertion holes 18*a* and 18*b* (FIG. 1), respectively, that are formed symmetrically with reference to the longitudinal hole 15 on the rear side 10*b* of the cleaner body 10. The first and second clamps 21 and 23 are rotatably engaged with first and second hinge pins 24*a* and 24*b*. The ends of the first and second clamps 21 and 23 adjacent to each other are engaged with each other by an elastic member such as a coil spring 25 (FIG. 5A). Alternatively, and referring to FIG. 5B, a pair of torsion springs 25*a*, and 25*b* may be disposed around the first and second hinge pins 24*a* and 24*b*, in which case a first end of each torsion spring 25*a* and 25*b* may preferably be fixed to a portion of the cleaner body 10, and a second end may preferably be fixed to a portion of the first and second clamps 21 and 23.

The first and second clamps 21 and 23 include pressed portions 21*a* and 23*a* formed on the adjacent sides of the first and second clamps 21 and 23, to be pressed by the extension pipe 40 when the cleaner body 10 is mounted to the extension pipe 40. Additionally, the first and second clamps 21 and 23 include fixing portions 21*b* and 23*b* to fix the hose 60 to the opposite sides to the pressed portions 21*a* and 23*a*. The fixing portions 21*b* and 23*b* are provided in a hook configuration with a predetermined radius of curvature to wrap the hose 60 securely.

Figure 6:
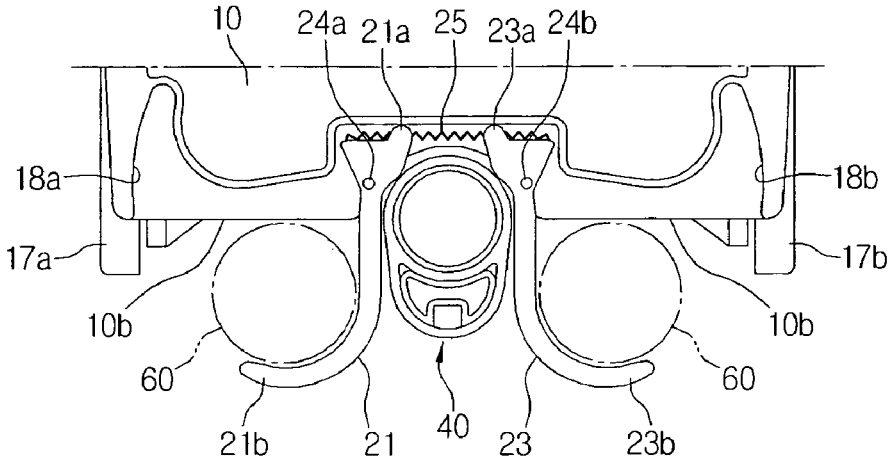
FIG. 6 illustrates the hose clamping device of the vacuum cleaner according to the first exemplary embodiment of the present disclosure in the upright mode.

Referring to FIG. 4, the first and second clamps are received in the first and second insertion holes 18*a* and 18*b* of the cleaner body 10 in the canister mode in which the cleaner body 10 is separated from the extension pipe 40. The fixing portions 21*b* and 23*b* of the first and second clamps 21 and 23 are protruded outside the first and second insertion holes 18*a* and 18*b*, as illustrated in FIG. 6, in the upright mode in which the cleaner body 10 is connected to the extension pipe 40.

Referring to FIG. 3, the suction port body 30 includes a suction port (not illustrated) formed in the bottom to draw in air and dust from outside, and a hinge portion 31 formed on the rear portion and connected with the suction port body 30. The hinge portion 31 is removably connected with the lower portion of the extension pipe 40, and includes a first supporting protrusion 35 formed on the front portion, to be removably engaged with the first fixing hole 19*a* (FIG. 2) of the cleaner body 10. Main wheels 33*a* and 33*b* are arranged on the rear opposite sides of the suction port body 30, to help the suction port 30 move smoothly along the floor being cleaned.

The extension pipe 40 is capable of telescopically extending its length by an extending button 41. The extension pipe 40 includes a second supporting protrusion 45 formed on the front portion of the extension pipe 40, to be removably engaged with the second fixing hole 19*b* (FIG. 2) of the cleaner body 10.

The operating handle 50 facilitates changing of direction of the vacuum cleaner 1 on the floor. One end of the operating handle 50 is connected to the upper portion of the extension pipe 40, and the opposite end is connected to one end of the hose 60. A host connector 61 is connected to the opposite end of the hose 60 so that the hose 61 is connected to the connector receiving hole 13*a* of the cleaner body 10 through the hose connector 61.

In order to change the upright mode to the canister mode in the vacuum cleaner 1 according to the first exemplary embodiment of the present disclosure, the cleaner body 10 is separated from the extension pipe 40, and the extension pipe 40 is separated from the hinge portion 31 of the suction port body 30.

The operation of the hose clamping unit 20 in association with the mode change of the vacuum cleaner 1 according to the first exemplary embodiment of the present disclosure will be explained below with reference to the accompanying drawings.

The vacuum cleaner 1 according to the first exemplary embodiment of the present disclosure is convertible from upright mode (FIG. 1) to canister mode (FIG. 3) or vice versa, and the example of converting from the canister mode to the upright mode will be explained below.

In the canister mode, the first and second clamps 21 and 23 of the hose clamping unit 20 are completely received in the first and second insertion holes 18*a* and 18*b* of the cleaner body 10, so as not to protrude out of the rear surface 10*b* of the cleaner body 10. Accordingly, the first and second clamps 21 and 23 do not scratch the floor being cleaned, while the vacuum cleaner 1 cleans the floor with the rear surface 10*b* of the cleaner body 10 facing the floor.

In order to convert the vacuum cleaner 1 from the canister mode to the upright mode, user lifts the cleaner body 10 until the extension pipe 40 is placed approximately at a right angle with respect to the suction port body 20, and causes the first supporting protrusion 35 of the hinge portion 31 to be inserted in the first fixing hole 19*a* of the cleaner body 10.

The user subsequently pushes the upper portion of the cleaner body 10 toward the extension pipe 40, and inserts the second supporting protrusion 45 of the extension pipe 40 in the second fixing hole 19*b* of the cleaner body 10. In this process, the hose clamping unit 20 is is pressed by the extension pipe 40. The operations of the hose clamping unit 20 will be explained below in a sequential manner.

Referring to FIG. 5A, the pressed portions 21*a* and 23*a* of the first and second clamps 21 and 23 are pressed by the extension pipe 40, when the extension pipe 40 is inserted in the longitudinal hole 15 of the cleaner body 10. At this time, the pressed portions 21*a* and 23*a* are turned about the first and second hinge pins 24*a* and 24*b* toward the cleaner body 10. At the same time, the fixed portions 21*b* and 23*b* of the first and second clamps 21 and 23 are turned about the first and second hinge pins 24*a* and 24*b* to protrude outside the first and second insertion holes 18*a* and 18*b* of the cleaner body 10.

As the gap between the first and second clamps 21 and 23 and the pressed portions 21*a* and 23*a* widens, the coil spring 25 is subjected to a greater tension than before the first and second clamps 21 and 23 are turned. As a result, the first and second clamps 21 and 23 are subjected to the tension force due to the coil spring 25.

Referring to FIG. 6, if the fixing portions 21*b* and 23*b* of the first and second clamps 21 and 23 protrude outside the cleaner body 10, the hose 60 is interposed between the fixing portions 21*b* and 23*b* and the rear surface 10*b* of the cleaner body 10 and fixed in place. Since the first and second clamps 21 and 23 in the turned state are under the influence of recovery force of the coil spring 25, the first and second clamps 21 and 23 can support the hose 60 firmly.

In order to convert the vacuum cleaner 1 from the upright mode to the canister mode, the hose 60 is separated from the fixing portions 21*b* and 23*b* and the rear surface 10*b* of the cleaner body 10, and the cleaner body 10 is separated from the extension pipe 40. Accordingly, the pressed portions 21*a* and 23*a* of the first and second clamps 21 and 23 are pulled close toward each other due to the recovery force of the coil spring 25.

Accordingly, the fixing portions 21*b* and 23*b* of the first and second clamps 21 and 23 are turned about the first and second hinge pins 24*a* and 24*b* and inserted in the first and second insertion holes 18*a* and 18*b*.

As explained above, according to the first exemplary embodiment of the present disclosure, the hose clamping unit 20 is operated to convert the upright mode to canister mode or vice versa, as the user connects the cleaner body 10 to the extension pipe 40 or separates the cleaner body 10 from the extension pipe 40 without having to do any extra work.

Accordingly, in the canister mode, the first and second clamps 21 and 23 are completely received in the first and second insertion holes 18*a* and 18*b* of the cleaner body 10 and so do not protrude outside the rear surface 10*b* of the cleaner body 10, while in the upright mode, the fixing portions 21*b* and 23*b* of the first and second clamps 21 and 23 protrude outside the rear surface 10*b* of the cleaner body 10. Accordingly, the first and second clamps 21 and 23 do not scratch or damage the floor being cleaned while the vacuum cleaner 1 is operated in the canister mode.

Figure 7:
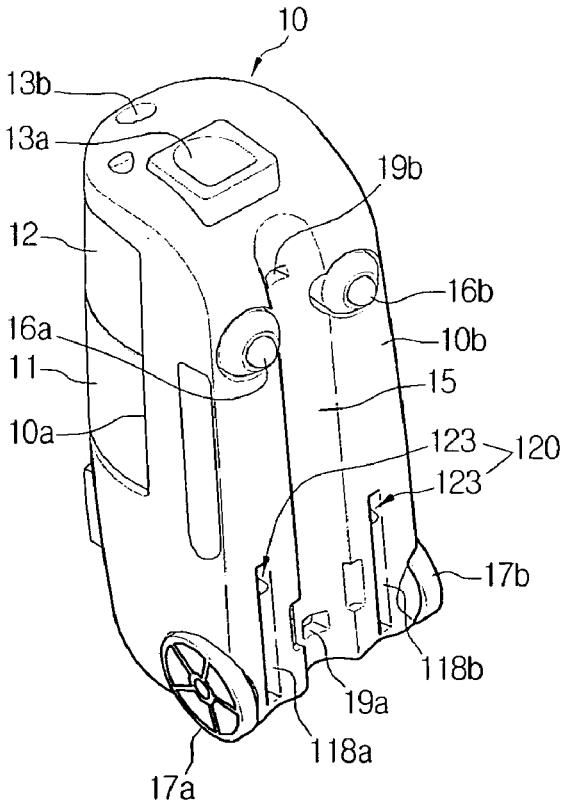
FIG. 7 is a perspective view illustrating a cleaner body of a vacuum cleaner according to a second exemplary embodiment of the present disclosure.
Figure 8:
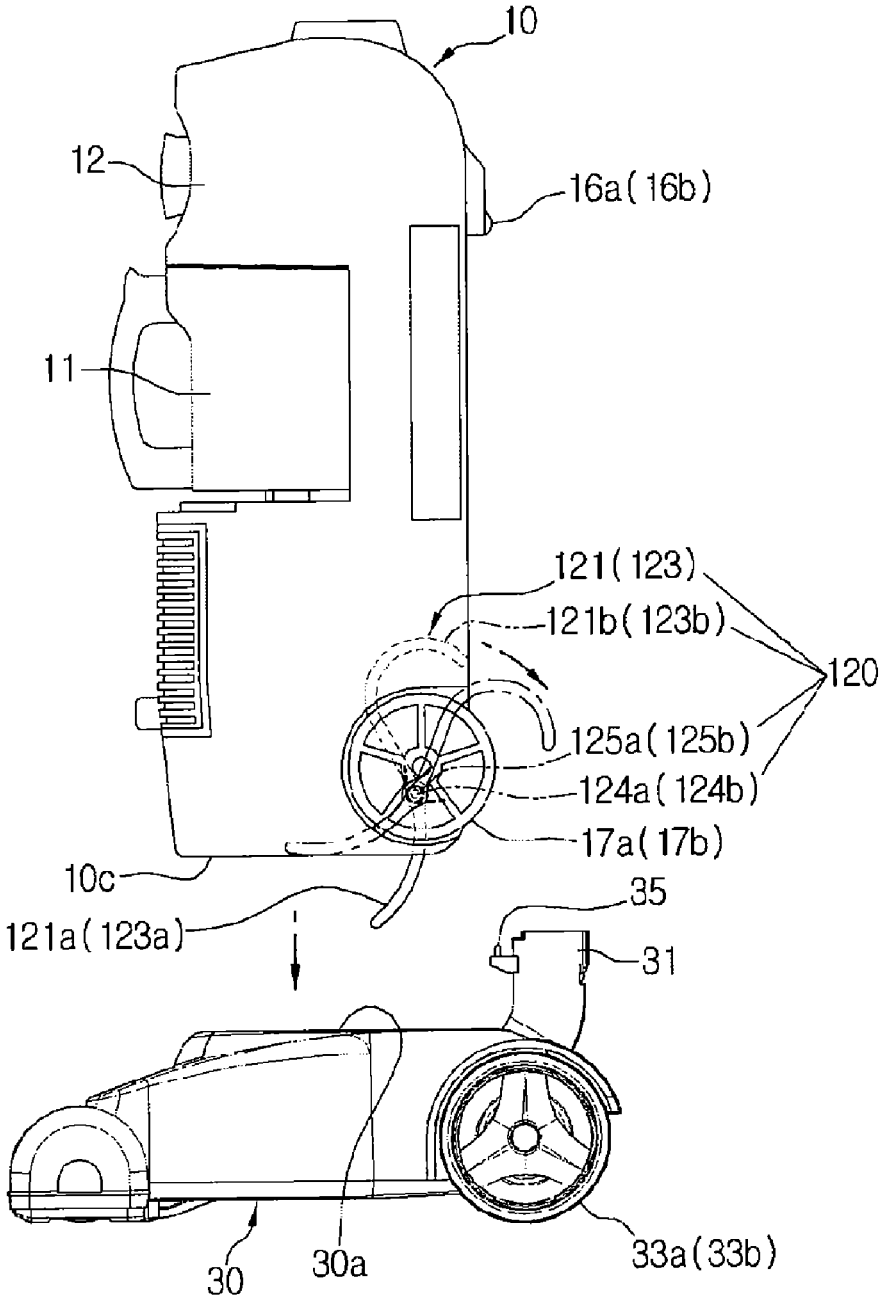
FIG. 8 illustrates a hose clamping device of the vacuum cleaner in use according to the second exemplary embodiment of the present disclosure.

FIG. 7 is a perspective view illustrating a cleaner body of a vacuum cleaner according to a second exemplary embodiment of the present disclosure, and FIG. 8 illustrates a hose clamping device of the vacuum cleaner in use according to the second exemplary embodiment of the present disclosure.

The vacuum cleaner according to the second exemplary embodiment of the present disclosure has the similar arrangement as the vacuum cleaner according to the first exemplary embodiment, except for a hose clamping apparatus 120. The hose clamping apparatus 120 will be explained in greater detail below.

Referring to FIG. 8, the hose clamping apparatus 120 is disposed in first and second insertion holes 118*a* and 118*b* of the cleaner body 10, which are arranged symmetrically with reference to a longitudinal hole 15. The hose clamping apparatus 120 is capable of protruding out of the first and second insertion holes 118*a* and 118*b*. Unlike the horizontal arrangement of the first and second insertion holes 18*a* and 18*b* of the first exemplary embodiment, the first and second insertion holes 118*a* and 118*b* are provided in vertical arrangement according to the second exemplary embodiment.

Referring to FIG. 8, the pressed portions 121*a* and 123*a* of the first and second clamps 121 and 123 protrude outside a lower surface 10*c* of the cleaner body 10 when the vacuum cleaner 1 is in the canister mode. Since the pressed portions 121*a* and 123*a* do not face the floor being cleaned, the pressed portions 121*a* and 123*a* do not damage the floor while the cleaner body 10 is moved.

The first and second clamps 121 and 123 are movably disposed in the first and second insertion holes 118*a* and 118*b* to be turned by the first and second hinge pins 124*a* and 124*b*. The first and second hinge pins 124*a* and 124*b* each include first and second torsion springs 125*a* and 125*b*, to cause the first and second clamps 121 and 123 to turn elastically when the vacuum cleaner 1 is converted from the canister mode to the upright mode.

During conversion from the upright mode to canister mode or vice versa, the first and second clamps 121 and 123 are protruded or retreated as the fixing portions 121*b* and 123*b* are turned within the first and second insertion holes 118*a* and 118*b* in a vertical direction.

The first and second clamps 121 and 123 are elastically disposed in the first and second insertion holes 118*a* and 118*b* by use of the first and second torsion springs 125*a* and 125*b* according to the second exemplary embodiment. Alternatively, a pair of coil springs may be employed instead of the first and second torsion springs 125*a* and 125*b*.

The operation of the hose clamping apparatus 120 of the vacuum cleaner 1 according to the second exemplary embodiment of the present disclosure will be explained below with reference to FIG. 8.

In order to convert the vacuum cleaner 1 from the canister mode to the upright mode, as explained above in the first exemplary embodiment, the user holds the cleaner body 10 approximately at upright position and connects the cleaner body 10 to the extension pipe 40.

The pressed portions 121*a* and 123*a* of the first and second clamps 121 and 123 are pressed by a top surface 30*a* of the suction port body 30, as the cleaner body 10 is seated on the top surface 30*a* of the suction port body 30. As a result, the pressed portions 121*a* and 123*a* are turned about the first and second hinge pins 124*a* and 124*b* to be inserted in the first and second insertion holes 118*a* and 118*b*.

The fixing portions 121*b* and 123*b* of the first and second clamps 121 and 123 are protruded outside the first and second insertion holes 118*a* and 118*b*, and at this time, the hose 60 is fixed between the fixing portions 121*b* and 123*b* and the rear surface 10*b* of the cleaner body 10. Due to the recovery force of the first and second clamps 121 and 123 by the first and second torsion springs 125*a* and 125*b*, the user can grip the hose 60 stably.

According to the exemplary embodiments of the present disclosure, the hose clamping unit is operated as the user changes the operation mode of the vacuum cleaner from the upright mode to the canister mode or vice versa, without requiring user's additional manipulations.

Furthermore, since the hose clamping unit is inserted in the cleaner body when the vacuum cleaner is in the canister mode, the hose clamping unit does not scratch or damage the floor being cleaned.

Although representative exemplary embodiment of the present disclosure has been shown and described in order to exemplify the principle of the present disclosure, the present disclosure is not limited to the specific embodiment. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A vacuum cleaner convertible between an upright mode and a canister mode, as a cleaner body, to which an extension pipe is connected via a hose, is separated from or connected to a suction port body, the vacuum cleaner comprising:

a hose clamping unit capable of protruding outside the cleaner body or retreating back to the cleaner body according to a mode change of the vacuum cleaner, wherein the hose clamping unit is elastically formed on the cleaner body.

2. The vacuum cleaner of claim 1, wherein the hose clamping unit has a portion that protrudes outside the cleaner body, when the extension pipe is connected to the cleaner body.

3. The vacuum cleaner of claim 1, wherein the hose clamping unit has a portion that protrudes outside the cleaner body, when the cleaner body is connected to the suction port body.

4. The vacuum cleaner of claim 2, wherein the protruding portion of the hose clamping unit is in a horizontal direction or a vertical direction with respect to the cleaner body.

5. The vacuum cleaner of claim 1, wherein the hose clamping unit comprises:

at least one clamp in which a first side is hinged and a second side includes a fixing portion to fix the hose; and an elastic member disposed around a hinged portion of the at least one clamp.

6. The vacuum cleaner of claim 5, wherein the elastic member is a coil spring to connect the at least one clamp to a portion of the cleaner body.

7. The vacuum cleaner of claim 5, wherein the elastic member comprises torsion springs disposed around hinged portions of the at least one clamp.

8. The vacuum cleaner of claim 1, wherein the hose clamping unit comprises:

first and second clamps provided in a symmetric arrangement in which sides adjacent to each other are hinged to the cleaner body, and sides apart from each other include fixing portions to fix the hose; and an elastic member to elastically support the first and second clamps with respect to the cleaner body.

9. The vacuum cleaner of claim 8, wherein the elastic member is a coil spring to connect the sides of the first and second clamps that face each other.

10. The vacuum cleaner of claim 8, wherein the elastic member includes first and second torsion springs formed on hinged portions of the first and second clamps.

11. The vacuum cleaner of claim 8, wherein the fixing portion is provided in a circular arrangement to wrap the hose.

12. A vacuum cleaner convertible between an upright mode and a canister mode, comprising:

a suction port body;

a cleaner body connectable to the suction port body when in the upright mode and separated from the suction port body when in the canister mode;

an extension pipe in fluid communication with the suction port body;

a hose fluidly connecting the extension pipe and the cleaner body; and a hose clamping unit capable of protruding outside the cleaner body or retreating back to the cleaner body according to the upright mode or the canister mode, wherein the hose clamping unit is elastically formed on the cleaner body.

13. The vacuum cleaner of claim 12, wherein the hose clamping unit comprises:

first and second clamps provided in a symmetric arrangement in which sides adjacent to each other are hinged to the cleaner body, and sides apart from each other include fixing portions to fix the hose; and an elastic member to elastically support the first and second clamps with respect to the cleaner body.

14. The vacuum cleaner of claim 13, wherein the fixing portion is provided in a circular arrangement to wrap the hose.

15. A vacuum cleaner convertible between an upright mode and a canister mode, as a cleaner body, to which an extension pipe is connected via a hose, is separated from or connected to a suction port body, the vacuum cleaner comprising:

a hose clamping unit capable of protruding outside the cleaner body or retreating back to the cleaner body according to a mode change of the vacuum cleaner, wherein the hose clamping unit comprises:

first and second clamps provided in a symmetric arrangement in which sides adjacent to each other are hinged to the cleaner body, and sides apart from each other include fixing portions to fix the hose; and an elastic member to elastically support the first and second clamps with respect to the cleaner body.

16. The vacuum cleaner of claim 15, wherein the elastic member is a coil spring to connect the sides of the first and second clamps that face each other.

17. The vacuum cleaner of claim 15, wherein the elastic member includes first and second torsion springs formed on hinged portions of the first and second clamps.

18. The vacuum cleaner of claim 15, wherein the fixing portion is provided in a circular arrangement to wrap the hose.

* * * * *